US009773659B2

(12) United States Patent
Gibson et al.

(10) Patent No.: US 9,773,659 B2
(45) Date of Patent: Sep. 26, 2017

(54) METAL HALIDE LAMP WITH CERAMIC DISCHARGE VESSEL

(75) Inventors: Ray Gibson, Bath, NY (US); Tom Steere, Hornell, NY (US); Junming Tu, Bath, NY (US)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 13/142,681

(22) PCT Filed: Dec. 15, 2009

(86) PCT No.: PCT/IB2009/055770
§ 371 (c)(1),
(2), (4) Date: Jun. 29, 2011

(87) PCT Pub. No.: WO2010/076725
PCT Pub. Date: Jul. 8, 2010

(65) Prior Publication Data

US 2011/0266955 A1 Nov. 3, 2011

Related U.S. Application Data

(60) Provisional application No. 61/141,271, filed on Dec. 30, 2008.

(51) Int. Cl.
*H01J 29/94* (2006.01)
*H01J 61/54* (2006.01)
(Continued)

(52) U.S. Cl.
CPC ..... *H01J 61/54* (2013.01); *H01J 61/125* (2013.01); *H01J 61/827* (2013.01)

(58) Field of Classification Search
CPC .. H01J 11/50; H01J 13/28; H01J 61/30; H01J 61/34; H01J 61/54; H01J 61/544;
(Continued)

(56) References Cited

U.S. PATENT DOCUMENTS 4,260,929 A 4/1981 Jacobs
4,323,812 A * 4/1982 Wyner et al. ..... 313/601
(Continued)

FOREIGN PATENT DOCUMENTS

EP 1294011 A2 3/2003
JP 55091560 A * 7/1980
(Continued)

*Primary Examiner* — Jimmy Vu
*Assistant Examiner* — Henry Luong

(57) ABSTRACT

A discharge lamp and a method for forming the lamp, the lamp including a ceramic discharge vessel defining at least part of a cavity containing a metal halide (MH) chemical filling having a power factor of between about 0.75 and 0.85 located within the cavity; and one or more feedthroughs having first and second ends, the first end located in the cavity. The cavity may have an internal length LINT and an internal diameter DINT that are proportional to each other, such that an aspect ratio defined as LINT/DINT is less than or equal to two. The lamp may be started and operated with a probe-start ballast without an internal igniter circuit or without a starting electrode (or internal igniter).

15 Claims, 11 Drawing Sheets

(51) Int. Cl.
*H01J 61/12* (2006.01)
*H01J 61/82* (2006.01)

(58) Field of Classification Search
CPC ..... H01J 61/547; H01J 61/827; H01J 61/00; H01J 61/12; H01J 61/18; H01J 61/35; H01J 61/125; H01J 61/366; H01J 65/00; H01J 29/94; H01J 37/3211; H01J 37/3222; H01Q 1/26
USPC .... 315/43, 34; 313/638, 634, 573, 620, 635, 313/637, 568, 572, 362.1, 481, 571; 445/26
See application file for complete search history.

(56) References Cited

U.S. PATENT DOCUMENTS 4,360,758 A * 11/1982 Thornton, Jr. ..... H01J 61/18 313/27
4,780,649 A * 10/1988 Scholz ..... H01J 61/825 315/101
5,541,480 A 7/1996 Renardus
6,198,223 B1 * 3/2001 Scholz ..... H01J 61/547 313/234
6,222,320 B1 4/2001 Stockwald
6,555,962 B1 4/2003 Jackson
6,798,139 B2 9/2004 Ramaiah
6,833,677 B2 * 12/2004 Jackson ..... H01J 61/0732 313/493
7,595,593 B2 * 9/2009 Genz ..... H01J 61/125 313/539
2003/0062831 A1 * 4/2003 Alderman et al. ..... 313/567
2003/0117061 A1 * 6/2003 Dombrowski et al. ..... 313/489
2003/0234613 A1 12/2003 Ramaiah
2005/0073256 A1 * 4/2005 Jackson et al. ..... 313/634
2005/0194908 A1 * 9/2005 Dakin ..... H01J 9/247 315/56
2006/0164014 A1 7/2006 Baldrige
2006/0164016 A1 * 7/2006 Rintamaki et al. ..... 313/638
2006/0164017 A1 * 7/2006 Rintamaki et al. ..... 313/640
2006/0226776 A1 10/2006 Chen
2007/0103070 A1 * 5/2007 Wyner et al. ..... 313/573

FOREIGN PATENT DOCUMENTS

JP S61216232 A 9/1986
JP 2004055319 A1 2/2004
JP 2005235434 A 9/2005
JP 2005259691 A 9/2005
JP 2005259691 A1 9/2005
WO 9848447 A1 10/1998
WO 9953522 A1 10/1999
WO 9953523 A1 10/1999
WO 2004001793 A1 12/2003
WO 2005088675 A1 9/2005
WO 2005093785 A2 10/2005

* cited by examiner

| Volts | |
|---|---|
| Mean | 113.8 |
| StDev | 1.452 |
| N | 5 |
| **Lumens** | |
| Mean | 34048 |
| StDev | 193.1 |
| N | 5 |
| **Im/W** | |
| Mean | 103.2 |
| StDev | 0.5994 |
| N | 5 |
| **CCT** | |
| Mean | 3791 |
| StDev | 18.23 |
| N | 5 |
| **CRI** | |
| Mean | 92.92 |
| StDev | 0.8009 |
| N | 5 |
| **MPCD** | |
| Mean | -5.046 |
| StDev | 2.352 |
| N | 5 |

METAL HALIDE LAMP WITH CERAMIC DISCHARGE VESSEL

The present disclosure relates generally to metal halide (MH) lamps, such as a ceramic MH lamps (CDM), and, more particularly, to an MH lamp having a shaped ceramic discharge vessel and which can provide enhanced illumination and starting characteristics, as well as a method of forming and operating the lamp.

In order to reduce costs, it becomes more advantageous to use high-efficiency "energy savings" lamps in order to lower energy use. Accordingly, it is desirable to replace existing lower efficiency lamps with high-efficiency lamps. Unfortunately, existing fixtures of certain types can be incompatible with many high-efficiency lamps. For example, many high-efficiency lamps are incompatible with conventional fixtures which use probe start ballasts (also known as switch start ballasts) for various reasons as will be described below. Accordingly, in order to use these high-efficiency lamps in conventional lighting fixtures which use probe start ballasts, these fixtures, or components thereof, must be replaced or updated so that they are compatible with the voltage requirements of these high-efficiency lamps. However, fixture replacements or updates are not always practical due to cost and/or time constraints.

With respect to probe start ballasts, about 90 percent of high-wattage (e.g., ranging from 175 W-1500 W) mercury (Hg) and quartz metal halide (QMH) ballasts in use in the United States are of this type. These probe start ballasts typically have a constant wattage autotransformer (CWA) circuit and do not have high-voltage igniters or high-voltage ignition circuits. Therefore, probe start ballasts can typically only provide a peak open circuit voltage of about 500V to start a lamp. Accordingly, in order to retrofit high-efficiency ceramic metal halide lamps (CDM) in these fixtures (having probe start ballasts), the CDM lamps must be able to start and run without receiving a starting pulse (of about 3000V) from a high-voltage ignition circuit (typically provided by a pulse start ballast, for example). Unfortunately, as many prior art CDM lamps require an ignition pulse of about 3000V, they are not compatible with probe start ballasts which do not incorporate a high voltage an ignition pulse. Further, although CDM lamps which are compatible with probe start ballasts are taught by the prior art, these lamps require bi-metal switches and/or starting electrodes which can increase complexity and cost.

For example, a typical CDM probe-start lamp that is compatible with probe-start ballasts is disclosed in U.S. Pat. No. 6,798,139, entitled "Three Electrode Ceramic Metal Halide Lamp" to Ramaiah et al., the contents of which are incorporated herein by reference. The arc tube of this CDM lamp has a starting electrode and bi-metal switch, which increase the complexity and cost of the lamp. Further, these components can also adversely affect the reliability of the lamp. Accordingly, there is a need for a CDM lamp which has a single feedthrough and is compatible with conventional probe-start ballasts.

Further, when using CDM lamp on a QMH probe start ballast, as opposed to a pulse start ballast (that provides a high voltage starting pulse, such as above 3000V), the CDM lamp may experience operating conditions which can include higher arc tube wall temperatures, increased arc bending, a wider range of operational powers, higher peak currents and/or a lower lamp voltage. These operating conditions can reduce the lifespan of the ballast and/or the CDM lamp. Accordingly, there is a need for a CDM lamp which can mitigate or eliminate one or more of the aforementioned operating conditions.

Moreover, a common method to increase the efficiency of MH lamps is to reduce the Hg dose and the lamp's voltage in order to operate the lamp below a nominal wattage. For example, to achieve a 10% power saving when using a 400 W ballast, an energy-efficient a lamp may be rated at 360 W instead of 400 W. However, assuming that these lamps have the same chemical filling (e.g., Na—Sc), then these lamps would have the same power factor. The lamp voltage ($L_V$) of an MH lamp is proportional to the lamp operating wattage ($L_{OW}$) and is inversely proportional to the power factor ($P_F$) and lamp current ($I_L$), respectively. This is illustrated in Equation (1) below.

$$L_V = L_{OW}/P_F * I_L \quad \text{(Eq. 1)}$$

Accordingly, an energy-saving QMH lamp with a rating of 360 W operating on a probe start ballast rated for 400 W has a nominal $L_V$ of 120V, as compared with an $L_V$ of 135V for a 400 W for the same lamp on the same ballast. Further, assuming that the $P_F$ for a typical CDM lamp with Na—Sc chemistry or filling is about 0.92, and that the voltage tolerance for $L_V$ can vary by ±15%, then the $L_V$ for the QMH 360-W lamp can fall within a range of 105V to 135V. Unfortunately, parts of this range can fall below a recommended minimum ballast voltage of about 120V for Vertical (V) or horizontal (HOR) positions. Accordingly, this low voltage condition can negatively affect ballast efficiency and lifespan. Further because of their lowered power value ($L_{OW}$), the use of conventional energy-saving lamps can have an adverse effect upon the lifespan of conventional ballasts, which can increase operating costs. Further, by operating a lamp at a lower $L_V$, using conventional chemical fillings, lumen output may also be compromised.

Thus, operation of CDM lamps on QMH probe start ballasts has many obstacles, chief of which are higher arc tube wall temperature, greater arc bending, wider range of operational powers, high peak currents (compared to electronic ballasts), and most importantly, low available ballast voltage for lamp starting.

Conventionally, in lamps which use a chemical filling that comprises a pure gas such as Ar, Kr, or Xe (including those with $Kr^{85}$), the breakdown voltage increases with increasing pressure. Therefore, to reduce the breakdown voltage, the chemical filling pressure is reduced. However, this reduction in pressure results in an increase in the Hydrogen iodide (HI) re-ignition voltage, which would cause the lamp to cycle out after only a few minutes. A known solution is to increase the product of the arc tube volume and pressure as is described in U.S. Pat. No. 6,555,962, entitled "Ceramic Metal Halide Lamp Having Medium Aspect Ratio" to Jackson et al., the contents of which are incorporated herein by reference. However, this design is not suitable for the present invention because the gas breakdown voltage maybe above that which is available from probe start ballasts, such as above 495-600 volts, for example.

Accordingly, there is a need for an energy saving QMH lamp with a lamp voltage ($L_V$) which is within a recommended ballast voltage range and/or has a limited arc bending. Further, there is a need for an energy saving CDM lamp which can be retrofit in existing lighting fixtures such as, for example, pulse-start or switch-start systems or lamps with internal igniters, without the need for bi-metal switches and/or starting electrodes. In addition, there is a need for an energy saving CDM lamp which has an arc tube length which is equivalent in size to a conventional probe start or switch start quartz lamps such that little or no modification is needed to replace these lamps with the energy saving lamp of the present invention.

Moreover, there is a need for an MH lamp having a chemical filling including a mixture selected from one of an Na—Tl—Ca—Ce—In iodide, NA-Tl—Ca—Ce—Mn iodide, Na—Tl—Ca—Ce—Mg iodide, Na—Tl—Ca—Ce iodide, Na—Tl—Ca—Ce—Cs iodide, Na—Tl—Ca—Ce—In—Cs iodide, and Na—Tl—Ca—Ce—Mn—Cs iodide fillings to improve color properties and lamp efficiencies.

According to one illustrative embodiment, a discharge lamp includes a ceramic discharge vessel defining at least part of a cavity containing a metal halide (MH) chemical filling having a power factor of between 0.75 and 0.85 (or between 0.80 and 0.85) located within the cavity; and one or more feedthroughs having first and second ends, the first end located in the cavity. The ceramic discharge lamp is configured to start and operate with a probe start ballast without an igniter circuit. The cavity may have an internal length $L_{INT}$ and an internal diameter $D_{INT}$ that are proportional to each other, such that an aspect ratio defined as $L_{INT}/D_{INT}$ is less than or equal to about two, such as approximately 1.2 to 2.0, as the optimal aspect ratio may also depend on the lamp power. The external length $L_{EXT}$ of the cavity 108 is also shown in FIG. 1.

The chemical filling may include a mixture selected from one of an Na—Tl—Ca—Ce—In iodide (sodium-thallium-calcium-cerium-indium iodides), Na—Tl—Ca—Ce—Mn (-manganese) iodide, Na—Tl—Ca—Ce—Mg (-magnesium) iodide, Na—Tl—Ca—Ce iodide, Na—Tl—Ca—Ce—Cs (-cesium) iodide, Na—Tl—Ca—Ce—In—Cs iodide, and Na—Tl—Ca—Ce—Mn—Cs iodide chemical fillings, as well as mercury (Hg). Further, the gas or chemical filling may include a Neon-Argon Penning mixture which comprises between 98-99.5% Ne and a remainder to 100% comprising or being Ar. The gas filling may further include a trace amount of $Kr^{85}$. Moreover, the gas filling has a pressure that is greater than or equal to about 150 Torr and less than or equal to about 200 Torr.

Each of the one or more feedthroughs may be separated from each other so as to define an arc length that is between about 12 mm and 14 mm. The discharge lamp may include an antenna coupled to one of the one or more feedthroughs. The antenna may be formed in whole or in part integrally with the discharge vessel and may be electrically coupled to one or more of the one or more feedthroughs. The antenna may comprise a passive or an active antenna types.

The discharge lamp may further include a quartz insulating sleeve situated around at least a part of the ceramic discharge vessel and/or having an inner diameter that is approximately between 20 mm and 28 mm and a length of approximately 50 mm to 70 mm. The quartz sleeve may influence hot/cold spot temperatures of the discharge tube.

The lamp may further include a gas (e.g., $N_2$, etc.) located between the ceramic discharge vessel and an outer envelope including the quartz sleeve, the gas may have a pressure that is between approximately 100 and 400 Torr. The gas may include a mixture of nitrogen N2, and/or a nitrogen-neon mixture (N2-Ne). The MH lamp according to the present system may have a power range of between about 150 to about 450 watts, although other power ranges are also envisioned, such as probe start MH lamps of up to and including 1500 watts.

According to another illustrative embodiment, a method for forming a discharge lamp includes the acts of: forming a ceramic discharge vessel defining at least part of a cavity; filling the cavity with a metal halide (MH) chemical filling having a power factor of between 0.75 and 0.85 (or 0.80 and 0.85) located within the cavity; and positioning one or more feedthroughs partially within the cavity so as to seal the cavity so that the ceramic discharge lamp starts and operates with a probe start ballast without an igniter circuit The act of filling further may include inserting a Neon-Argon Penning mixture within the cavity, the Neon-Argon (Ne—Ar) Penning mixture having between about 98.0 and 99.5% Ne, where the remainder of the Ne—Ar Penning mixture is or comprises Ar. Further, the act of filling may further include inserting a trace amount of $Kr^{85}$ within the cavity. Moreover, the act of filling may further include adjusting the pressure of the chemical or gas filling such that the filling has a pressure that is greater than or equal to 150 Torr and less than or equal to 250 Torr.

According to the method, the act of positioning the one or more feedthroughs may include positioning each of the one or more feedthroughs separate from each other so as to define an arc length that is, for example, between about 10 mm and about 16 mm, and longer for higher power lamps.

The method may further include forming an antenna and coupling the antenna to the one or more feedthroughs. The antenna may be formed integrally with the discharge ceramic discharge vessel or may be formed separately from the ceramic discharge vessel. It should be understood that the antenna is optional and may not be necessary for starting the lamp.

The method may further include positioning a quartz sleeve around at least a part of the ceramic discharge vessel. Further, the method may include filling an area that is between the quartz sleeve and the discharge vessel with a gas having a pressure that is between 100 and 400 Torr.

According to yet another illustrative embodiment, a discharge lamp may include: an outer envelope defining at least part of a first cavity; a ceramic discharge vessel situated within the first cavity and defining at least part of a second cavity containing a metal halide (MH) chemical filling having a power factor of between about 0.75 and 0.85; and one or more feedthroughs having first and second ends, the first ends located in the second cavity. The second cavity may have an internal length $L_{INT}$ and an internal diameter $D_{INT}$ that are proportional to each other, such that an aspect ratio defined as $L_{INT}/D_{INT}$ is less than or equal to two (e.g., 1.2 to 2.0). However, other aspect ratios are also envisioned. The ceramic discharge lamp starts and operates with a probe start ballast without an igniter circuits, internal or external, such as without an internal probe, starting electrode, bimetal switch.

The present systems, methods, apparatus and devices provide a ceramic discharge metal halide (CDM) lamp for use on ballast systems with or without high-voltage ignition circuits. Further, the present system provides a CDM lamp which may include a Ne—Ar Penning gas mixture that has a buoyancy that is greater than other noble gases such as, for example, Ar, Kr, or Xe and can thus form an arc which has a controlled bend. It is also envisioned that the chemical filling gas may also include $NeKr^{85}$, Ar, Kr, and/or Xe.

Further areas of applicability of the present devices and systems and methods will become apparent from the detailed description provided hereinafter. It should be understood that the detailed description and specific examples, while indicating exemplary embodiments of the systems and methods, are intended for purposes of illustration only and are not intended to limit the scope of the system.

These and other features, aspects, and advantages of the apparatus, systems and methods of the present system will become better understood from the following description, appended claims, and accompanying drawing where:

The following description of certain exemplary embodiments is merely exemplary in nature and is in no way intended to limit the system, its applications, or uses. In the following detailed description of embodiments of the present systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed systems and methods, and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of certain features will not be discussed when they would be apparent to those with skill in the art so as not to obscure the description of the present system.

Figure 1:
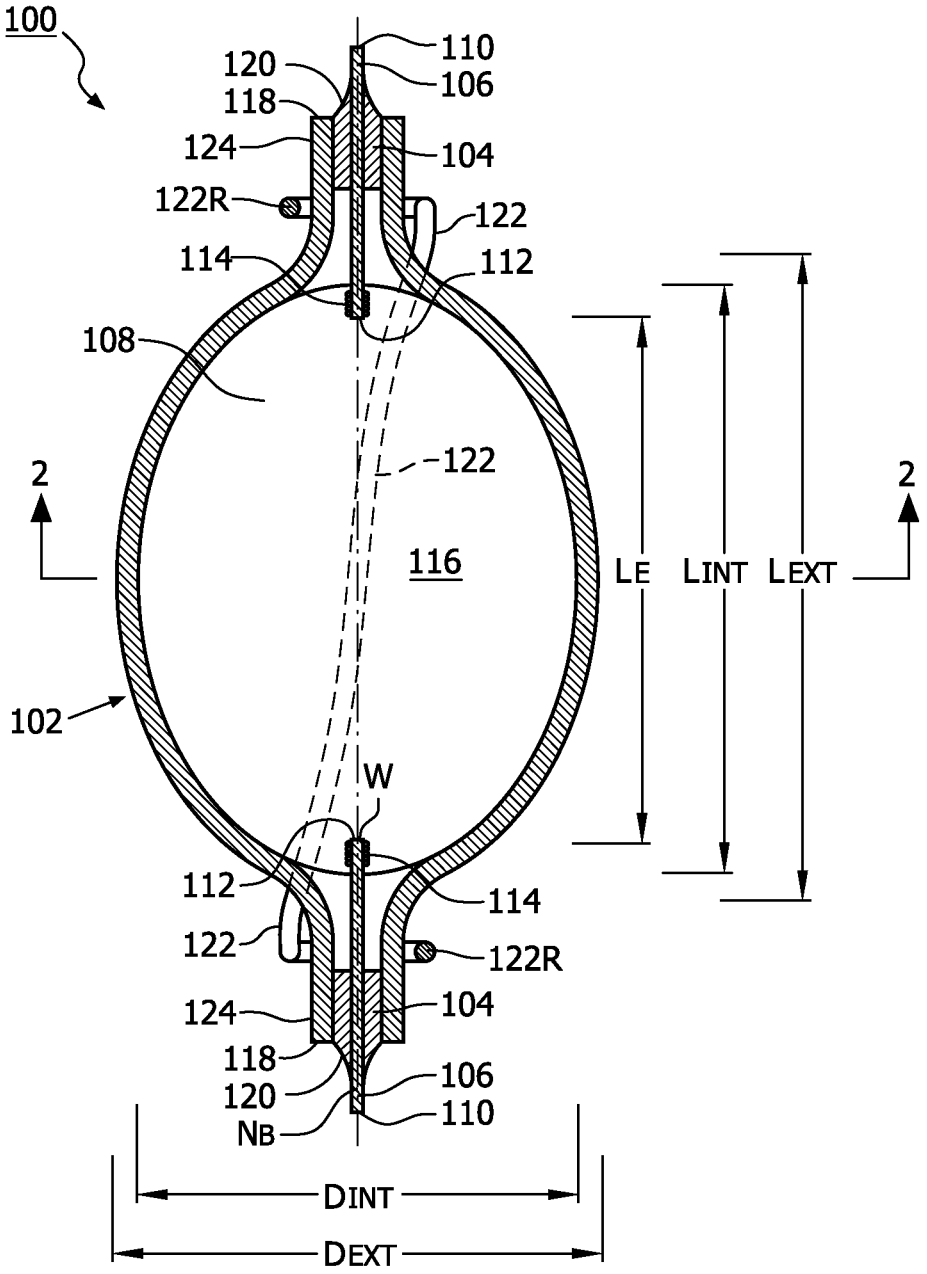
FIG. 1 is a cross section view of an MH lamp in accordance with an embodiment of the present system.

A cross section view of an MH lamp 100 in accordance with an embodiment of the present system is shown in FIG. 1. The lamp 100 may include one or more of a ceramic discharge vessel 102 of, for example, polycrystalline alumina, having vessel end portions 118, feedthroughs 106, and an antenna such as an active or passive antenna 122.

The discharge vessel 102 may have a shaped structure so as to define a discharge cavity 108 which may be located between the vessel end portions 118, and has a length $L_{INT}$ and an internal diameter $D_{INT}$. The internal length $L_{INT}$ and the internal diameter $D_{INT}$ may be proportional to each other such that an aspect ratio defined as $L_{INT}/D_{INT}$ is less than or equal to two. The inner cavity 108 may have a spherical shape and contain a desired chemical filling 116. The cavity 108 may have one or more openings 120 located at each vessel end portion 118. The opening 120 may be shaped and sized such that a suitable electrical lead such as, for example, a feedthrough 106, can pass therethrough. The cavity 108 may be filled with a suitable chemical filling which may include an ionizable filling which may include an inert gas such as neon (e.g., as a starting gas), a mixture of one or more metal halides, a trace of krypton 85 ($Kr^{85}$) and mercury as will be described below.

The cavity 108 may be sealed in a gas tight manner using any suitable seal. For example, the seal may include frit 104 which may be situated between the discharge vessel 102 and portions of an adjacent feedthrough 106 so as to seal the cavity 108. The frit 104 may be formed using any suitable material and may include glass, barium, or other suitable sealing and/or insulating materials. Further, suitable materials for the frit may have a thermal expansion rate which is similar to the thermal expansion rate of the discharge vessel so that unnecessary stress to the lamp 100, or portions thereof, may avoided when the lamp undergoes heating/cooling during use. The cavity 108 may include a penning gas mixture such as Ne—Ar and/or Ar—Hg. The discharge vessel 102 may be formed using a suitable technique. For example, the discharge vessel 102 may be formed from an injection molded material that may then be subject to an air bake technique. Care should be taken so as maintain the purity of the discharge vessel and so that H contamination is reduced or prevented so as to reduce or prevent $H^-$ spikes during use.

Each of the feedthroughs 106 has first and second feedthrough ends 112 and 110, respectively, and an electrode 114 which may be located next to the first end 112 such that the electrode 114 may be located within the cavity 108. The feedthroughs 106 may be formed from one or more materials and may be separated from each other by a distance $L_E$, being the electrodes tip to tip distance as shown in FIG. 1. The feedthroughs 106 may be formed from any suitable material. For example, one or more of the feedthroughs 106 may include a three part construction which includes, for example, niobium (Nb), cermet, and tungsten (W). The Nb portion of the feedthrough 106 may be located in a part of the feedthrough 106 that may be adjacent to the second or outer end 110, the W portion of the feedthrough 106 may be located in a part of the feedthrough 106 which may be adjacent to the first or inner end 112, and the cermet portion of the feedthrough 106 may be located between the Nb and W portions. Further, the feedthroughs 106 may include one or more embossed sections to, for example, aid sealing of the cavity 108.

An antenna 122 may be used to aid starting and can include passive or active antenna types. Although a wire antenna is shown, the antenna may include other antenna types such as, for example, a Philips Invented Antenna (PIA)-type antenna, such as described in U.S. Pat. No. 5,541,480, "High Pressure Discharge Lamp with Metal Layer on Outer Surface," to Renardus et al., and/or U.S. Pat. No. 4,260,929, entitled "High-Pressure Sodium Vapor Discharge Lamp," to Jacobs et al., the contents of both are incorporated herein by reference. The antenna 122 may extend along, for example, an exterior portion of the discharge vessel 102 in an area that lies between the electrodes 114. Further, the antenna 122 may include one or more rings 122R which may partially and/or fully encircle any exterior portion (e.g., the necks 124) of the discharge vessel 102. The antenna 122 may be formed using any suitable conductive material such as, for example, Tungsten, molybdenum (Mo), tantalum (Ta), alloys thereof, etc. Moreover, the antenna 122 can be formed either in whole, or in part, integrally with the discharge vessel 102. For example, the antenna 122 may include a conductive material which is formed, at least in part, upon the discharge vessel 102. Further, the antenna may include an integrated hybrid (ignition) antenna as is described in U.S. Provisional Patent Application No. 61/079,514, filed on Jul. 10, 2008, entitled "High-Pressure Sodium Vapor Discharge Lamp with Hybrid Antenna," the contents of which are incorporated herein by reference. Thus, an antenna may be provided to reduce ignition pulse values as well as manufacturing cost and complexity. In the various embodiments described herein, the antenna may be passive, active and/or a hybrid antenna.

Cermets may include any suitable cermet such as a 35-55% molybdenum (moly) cermets. Further, a 55% moly cermet may yield a luminous efficacy which may be about 6% higher than the luminous efficacy provided when using a 35% moly cermet. However, other values for cermets are also envisioned.

The chemical filling 116 can include a combination of elements which have a desired power factor and/or lumen output. For example, it is envisioned that the power factor may be varied from about 0.75 to 0.85 (or 0.80 to 0.85), as desired. For example a Na—Tl—Ca—Ce—In iodide chemical filling may be used which may yield a power factor of about 0.83. However, other chemical fillings are also envisioned. For example, the chemical filling may include NA-Tl—Ca—Ce—Mn, Na—Tl—Ca—Ce—Mg, Na—Tl—Ca—Ce, Na—Tl—Ca—Ce—Cs, Na—Tl—Ca—Ce—In—Cs, and Na—Tl—Ca—Ce—Mn—Cs iodides to realize desired color properties such as a color temperature of 3000 or 4000K. Further, the chemical filling may include a salt such as, for example, a 4K salt mix. For a 400 W replacement lamp having an $L_V$ of about 135V a salt mix of 40 mg of CDM 4 k salts+4.0 mg NaI additional+CsI. The chemical filling may include an Hg dose of, for example, 5.3 mg. However other Hg doses are also envisioned.

Accordingly, taking Equation 1 into consideration, a lamp with a chemical filling having a lower power factor may yield a higher $L_V$ than a similar lamp with an Na—Sc chemical filling. An additional benefit of the Na—Na—Tl—Ca—Ce—In iodide chemical filling is that it has a higher lumen output than a conventional Na—Sc chemical filling in a lamp which is rated at the same power (i.e., the same $L_{OW}$). Accordingly, even if the $L_{OW}$ of a lamp is lowered, a similar lumen output may be obtained by using a chemical filling having a low power factor. Further advantages of this chemical filling may include an $L_V$ range which better matches the nominal $L_V$ of a ballast when using an energy saving lamp. Experimental comparison of 100-hour electrical and technical properties for a 340 W lamp according to the present system and a conventional 400 W lamp on a conventional 400 W MH using a probe- or pulse start-type ballast (such as an M59 or M135-type ballasts) are shown in Tables 1 and 2 below.

TABLE 1

Electrical Properties

| Lamp | Current ($I_L$) | Voltage ($L_v$) | Operating Watts ($L_{ow}$) | Energy Saving | Energy saving % | Power Factor ($P_F$) | chemical filling |
|---|---|---|---|---|---|---|---|
| Present System | 3.0 A | 136 V | 340 W | 60 W | 15% | 0.83 | Na—Tl—Ca—Ce—In |
| Conventional | 3.25 | 135 V | 400 W | 0 | 0 | 0.91 | Na—Sc |

TABLE 2

Technical Properties

| Lamp | Lumens | Efficacy | CCT | CRI | R9 | MPCD | Mean Lumens |
|---|---|---|---|---|---|---|---|
| Present system CDM 340 W | 36200 | 105 Lm/W | 3860K | 90 | 50 | ≈8 | 28960 |
| Conventional (Na—Sc) QMH 400 W | 36000 | 90 Lm/W | 4000K | 65 | Negative | ≈20 | 23400 |

With reference to Table 1 above, it is seen that the lamp voltage ($L_V$) and current ($I_L$) for the 340 W lamp according to the present system are similar to corresponding values of a conventional QMH 400 W lamp. Accordingly, as these values are in accord with corresponding nominal values of the ballast (e.g., a 400 W ballast), the efficiency and lifespan of the ballast are not adversely affected by the 340 W lamp according to the present system.

Moreover, with reference to Table 2 above, it is seen that the 100-hour light output (in lumens) of the 340 W lamp according to the present system is similar to the output of the conventional QMH 400 W lamp. However, after about 8000 hours of operation, the light output (in means lumens) for the 340 W lamp according to the present system exceeds that of the conventional QMH 400 W. Further, color properties which can include color rendering index and MPCD (mean perceptible color difference) of the 340 W lamp according to the present system exceeds those of the conventional QMH 400 W lamp. Lastly, an expected color shift of about 200K over the life of a lamp according to the present system is less than an expected color shift of 600K over the life of an equivalent conventional QMH lamp.

Although specifications are shown for a 340 W lamp, it is envisioned that the lamp according to the present system may include lamps which range from, for example, 175-1000 W or more. Moreover, the lamp according to the present system may provide an energy savings which is about 15-20% greater than that of conventional QMH lamps while providing an equivalent lumen output. This is better illustrated with reference to Table 3 below wherein energy savings for various lamp wattages according to the present system are shown.

TABLE 3

| Conventional Lamps Operating Watts ($L_{OW}$) | Present System Operating Watts ($L_{OW}$) | Energy saving, % over conventional lamps |
|---|---|---|
| 175 W | 145 W | 30 W, 17% |
| 250 W | 205 W | 45 W, 18% |
| 320 W | 265 W | 55 W, 17% |
| 350 W | 290 W | 60 W, 17% |
| 400 W | 340 W | 60 W, 15% |
| 750 W | 630 W | 120 W, 16% |
| 1000 W | 850 W | 150 W, 15% |

Figure 2:
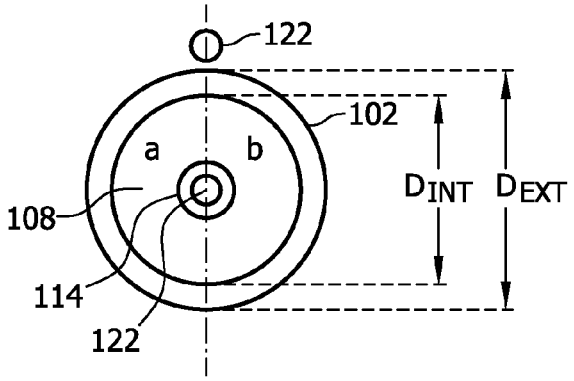
FIG. 2 is a cross sectional side view of the MH lamp taken along lines 2-2 of FIG. 1.

A cross sectional side view of the MH lamp taken along lines 2-2 of FIG. 1 according to the present system is shown in FIG. 2. As shown, the cavity 108 may include a circular or a substantially circular cross section. Accordingly, first and second radial sections a and b, which extend radially outward from a center axis of the cavity 108, may be equal to each other. A wall of the discharge vessel 102 in an area of the cavity 108 is defined by the difference between the external diameter ($D_{EXT}$) and the internal diameter $D_{INT}$ of the cavity 108. As arc bending may be reduced when the distance $L_E$ between the electrodes 114 (FIG. 1) is shortened, this distance $L_E$ may be selected such that arc bending is within a desired range. Additionally, reducing the distance $L_E$ between the electrodes 114 may increase the luminous efficiency of the lamp 100.

Figure 3:
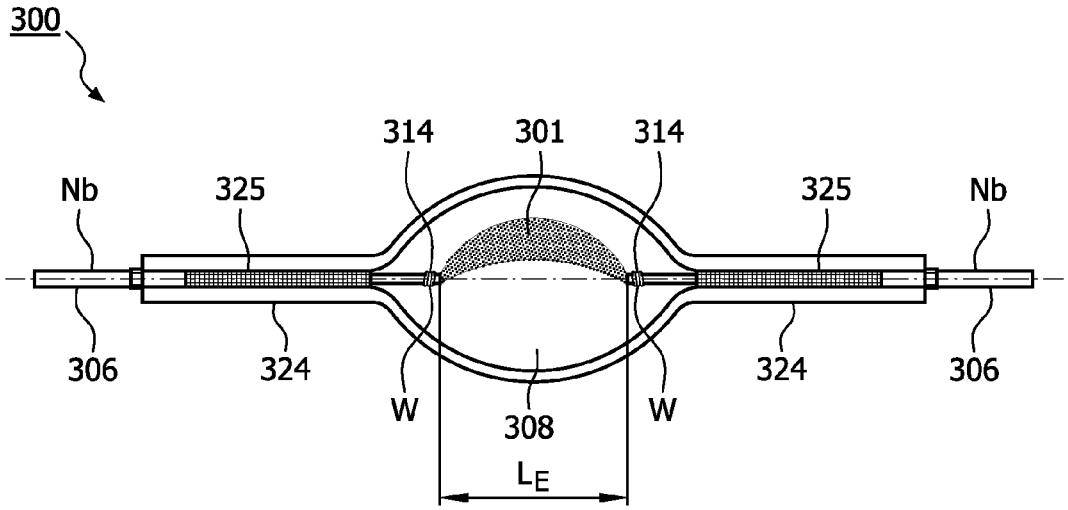
FIG. 3 is a cross section view of an MH lamp in accordance with an embodiment of the present system.

A cross section view of an MH lamp 300 in accordance with an embodiment of the present system is shown in FIG. 3. The lamp 300 is similar to the lamp 100 shown in FIG. 1 with a difference being that the neck portions 324 may be longer than the neck portions 124 of the lamp 100. Further, one or more of feedthroughs 306 may include a textured or embossed portion 325 to enhance sealing of the cavity 308. This embossed portion 325 may correspond with a cermet portion that is located between the inner W feedthroughs section and the inner Nb feedthroughs section, also described in connection with FIG. 1. An arc 301 is shown extended between the first and second electrodes 314. For the sake of clarity, an antenna is not shown. As the arc bend may be reduced when the distance $L_E$ between the electrodes 314 is shortened, this distance $L_E$ may be selected such that arc bend is within a desired range. Additionally, reducing the distance $L_E$ between the electrodes 114 may increase the luminous efficiency of the lamp.

Figure 4:
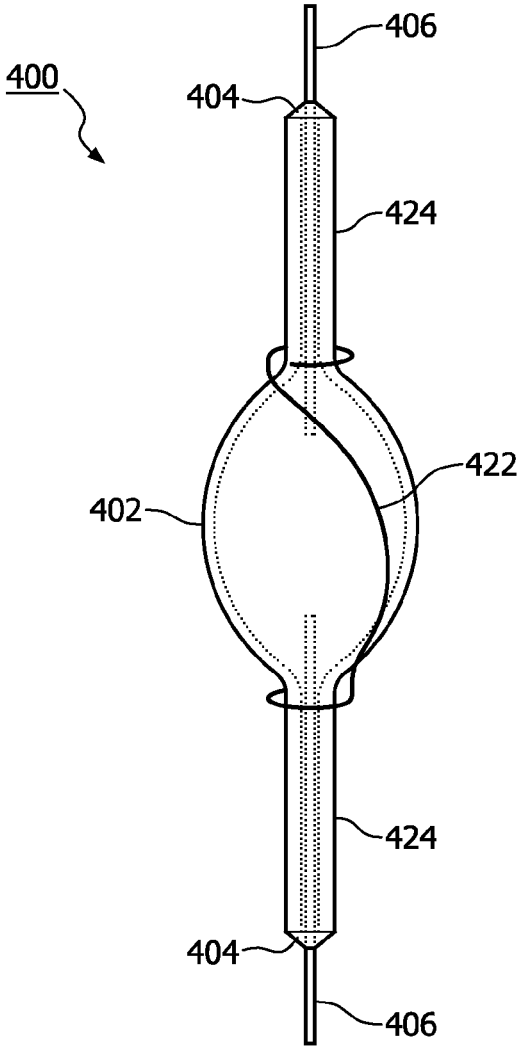
FIG. 4 is a side view of an MH lamp in accordance with an embodiment of the present system.

A side view of an MH lamp 400 in accordance with an embodiment of the present system is shown in FIG. 4. The lamp 400 may include an antenna 422 to aid starting. The antenna 422 may be formed from any suitable conductive material such as, for example, Tungsten (W), Molybdenum (Mo), Tantalum (Ta). As shown, the antenna 422 is formed using a wire which encircles one or more necks 424 of the lamp 400 such that it is electrically coupled to one or more of the feedthroughs 406. However, other methods of electrically coupling the antenna are also envisioned. For example, the antenna may be formed using a conductive material such as tungsten which is deposited upon and/or formed integrally with the discharge vessel 402. Further, the antenna 422, or parts thereof, may extend to and/or be deposited upon at least part of the seal glass (frit) 404. For example, a tungsten paste may be applied to a discharge tube (and/or parts of a button sealing one or more ends of the discharge tube) and may thereafter be "pulled" into the porosity of the formed alumina material of the tube by a few microns by a capillary action. Moreover, although a passive antenna is shown, it is also envisioned that an active antenna or hybrid antenna may be employed. Of course, an antenna may not be necessary for starting the lamp depending on the application and ballast used in the system.

Further, the antenna 422 may have a proximal end which is located adjacent to a feedthrough and/or to a distal end which is located somewhere between the necks 424 of the lamp 400 such that it is asymmetrical in relation to the discharge vessel 402. By controlling the length of the lamp according to the present system, the lamp may be easily retrofitted in applications which use a QMH- or MS-type lamp.

With regard to the gas filling 416 inside the discharge vessel 402, the gas filling 416 may include a Ne—Ar penning mixture where the fill pressure is adjusted (e.g., to between 150 and 250 torr) to reduce the breakdown (or starting) voltage and/or to reduce or prevent the formation of hydrogen iodide ($HI^-$) re-ignition voltage spikes that may cause a lamp to switch off during warm-up. Increased the chemical filling pressure is contrary to typical practice where, when using pure gasses (e.g., Ar, Kr, or Xe), the chemical filling breakdown voltages decrease with a reduction in chemical filling pressure. This will be more fully explained below with reference to FIGS. 10-13 below.

Further, the introduction of impurities such as hydrogen (H) into cavities of the lamp should be prevented so as to reduce or entirely eliminate undesirable effects such as, for example, $HI^-$ re-ignition voltage spikes, etc. Accordingly, $HI^-$ re-ignition voltage spikes can be prevented by controlling the type of starting gas, arc tube pressure, and/or arc tube volume. For example, by reducing the arc length (e.g., to about 10.1 mm and 12 mm for 210 W and 330 W lamps, respectively) from those used by an equivalent conventional lamp, and increasing the chemical filling pressure to at least 150 torr Ne—Ar, $HI^-$ re-ignition voltage spikes may be satisfactorily controlled. Further, the type of gas filling may be selected to reduce or entirely eliminate $HI^-$ re-ignition voltage spikes. For example, fewer $HI^-$ re-ignition voltage spikes were observed with an Xe filling than with Ar or Ne filling. Further, an Ar filling may yield fewer $HI^-$ re-ignition voltage spikes than an Ne filling.

Figure 5:
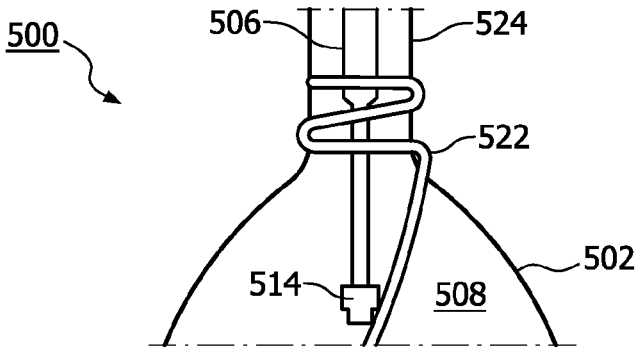
FIG. 5 is a detailed partial side view of an MH lamp in accordance with an embodiment of the present system.

A detailed partial side view of an MH lamp 500 in accordance with an embodiment of the present system is shown in FIG. 5. The lamp 500 may include at least one discharge vessel 502, a feedthrough 506, and an antenna 522. The feedthrough 506 may include an electrode 514 which is located within a cavity 508. The discharge vessel 502 may include a neck 524 which may have an outside diameter (or circumference) which is smaller than the outside diameter (or circumference) of a cavity portion 508 of the discharge vessel 502. The antenna 522 may be formed from a conductive material such as a tungsten (W), molybdenum (Mo), and/or tantalum (Ta) wire, and may include one or more ends which fully (or partially) encircle the neck 524 such that the antenna 522 may be electrically coupled to the feedthrough 506 to aid starting of the lamp 500. The diameter (or outside circumference) of the neck 524 may be adjusted in those portions which are adjacent to an end of the antenna 522 so as to adjust the electrical coupling between the feedthrough 506 and the antenna 522.

Figure 6:
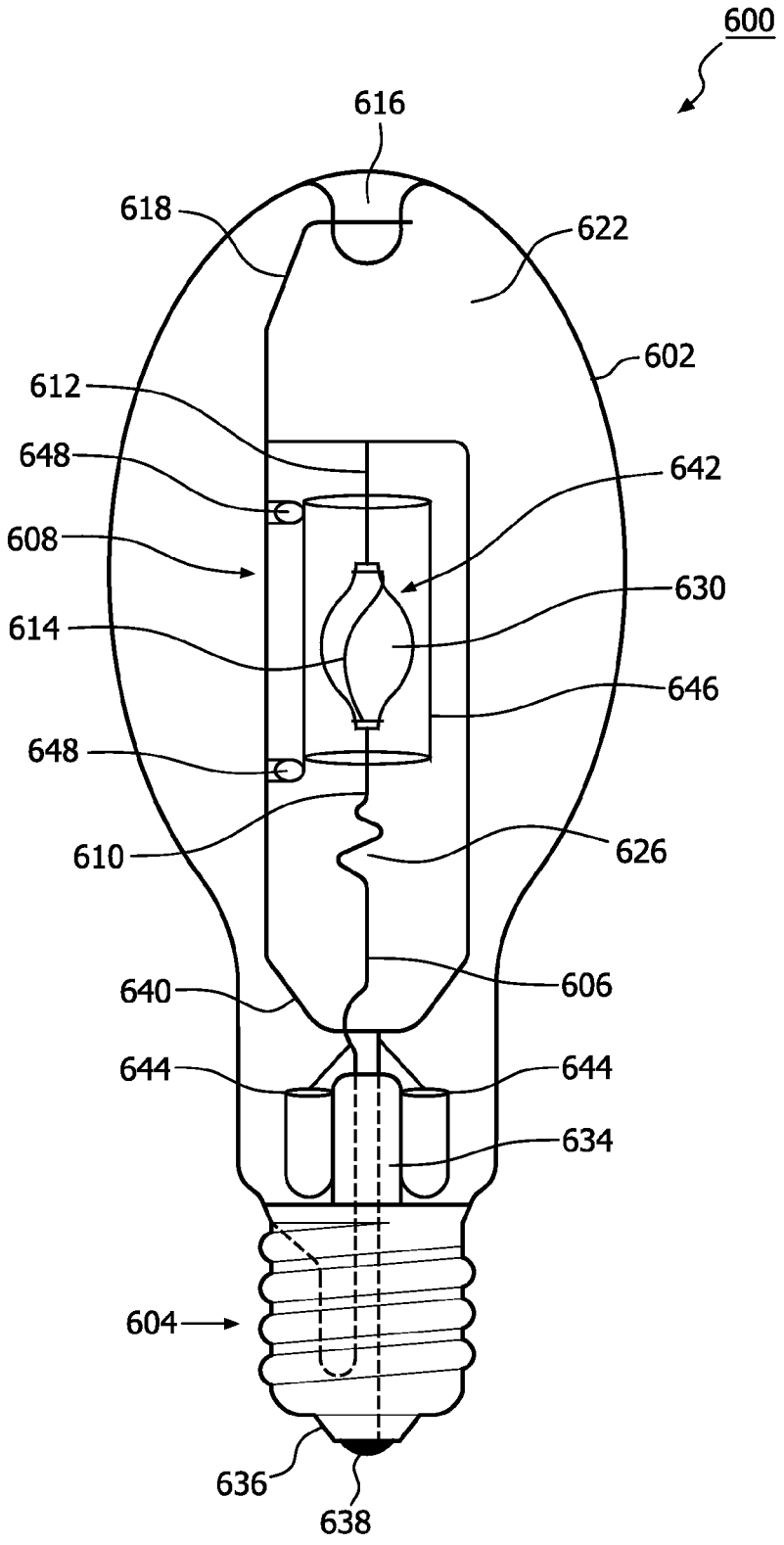
FIG. 6 is a side view of an MH lamp with an outer envelope in accordance with an embodiment of the present system.

A side view of an MH lamp 600 in accordance with an embodiment of the present system is shown in FIG. 6. The lamp 600 may include at least one outer envelope 602, a base 604, first and second stem leads 606 and 640, respectively, a (glass) stem 634, a wire frame 608, a dimple 616, and an illumination source such as, for example, a discharge lamp 642 which may be similar to, for example, lamps 100, 400.

Figure 7:
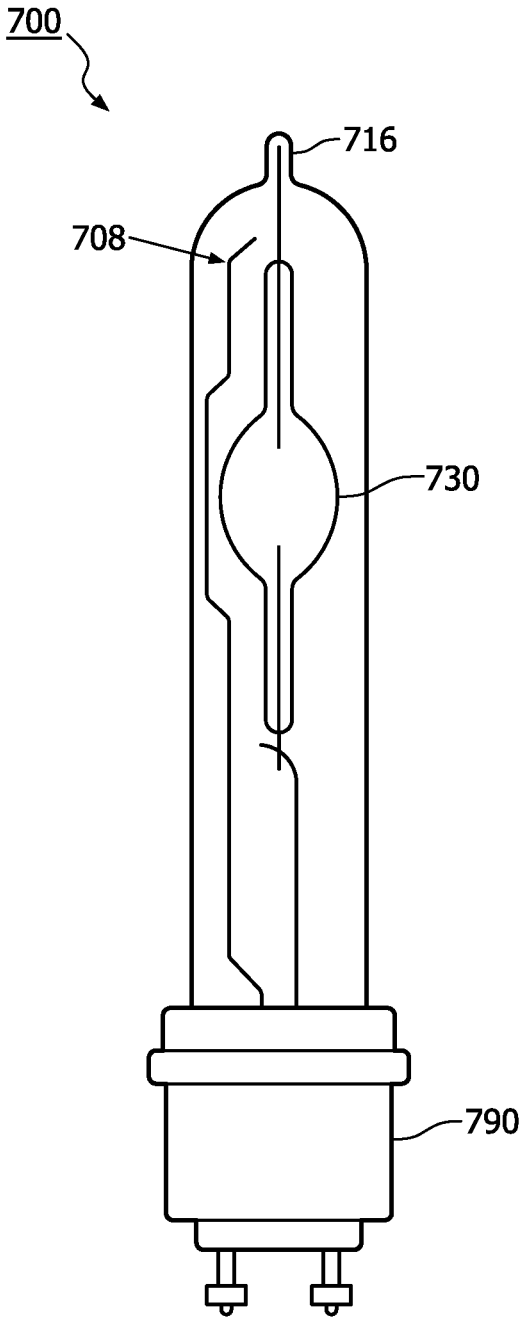
FIG. 7 is a side view of an MH lamp and outer envelope in accordance with another embodiment of the present system.

The outer envelope 602 may be formed from glass or other suitable material and is attached to a suitable base such as, for example, a threaded base 604. However, other bases, such as, for example, mini can, double contact bayonet (e.g., as shown in FIG. 7), medium and mogul bipost, recessed single contact, pin bases PG-12, etc., are also envisioned. The outer envelope 602 may form at least part of a cavity 622 in which the discharge lamp 642 is located.

The discharge lamp 642 may include a discharge vessel 630 (which may be formed from a PCA or other suitable material), feedthroughs 610, 612, and an antenna 614. The antenna 614 may be a passive, active or a hybrid antenna. The antenna 614 should be oriented such that it does not arc with components such as the wire frame 608 within the lamp.

The first and second stem leads 606, 640, respectively, form a frame for positioning the discharge lamp 642 and other elements and may be formed from a conductive material such as, for example, steel and may include a coating to prevent evaporation. For example, the first and second stem leads 606, 640, respectively, as well as other exposed conductive elements within the outer envelop 602, may include a nickel coating to reduce or entirely prevent evaporation (e.g., frame wire evaporation). The first and second stem leads 606, 640, respectively, should be separated from each other by a suitable distance such that arcing between them is prevented.

The first and second stem leads 606, 640 may be coupled to the base 604 and a conductive center contact 638, respectively, at their first ends. The end portion of first stem lead 606 may also be coupled to an extension 626 which is coupled to a feedthrough 610 of the discharge lamp 642. An end portion of the second stem lead 640 may be coupled to the wire frame 608 which may include an end portion 618 suitable for engaging a support device such as, for example, a dimple 616 which may be used to position the wire frame 608 relative to the outer envelope 602. However, it is also envisioned that other types of support devices may be used. Accordingly, the wire frame 608 may include an opening in which at least part of the dimple 616 may be situated. However, it is also envisioned that a positioning device, such as a wire, may be placed around the wire frame 608, if desired.

An end of the second wire stem lead 640 may be coupled to a corresponding feedthrough 612 of the discharge lamp 642 either directly or via one or more other leads. The stem leads and other electrical conduits should have enough clearance such that arcing is avoided between stem leads and/or conduits having opposite potentials. As shown in FIG. 6, the wire frame 608 forms a dual frame to reduce arc bending when the lamp 600 is placed in a horizontal position. However, a single frame (e.g., located on one longitudinal side of the discharge lamp 642 as opposed to two sides) may be used, if desired. Further, arc bending can be minimized by separating the frame (e.g., the stem leads 606, 640) from the discharge lamp 642.

The glass stem 634 forms at least part of the cavity 622 and may provide a passage (and a seal) for the first and second stem leads 606, 640, respectively, which may pass therethrough. An insulator 636 may be used to insulate the center contact 638 from the metal base 604.

The cavity 622 preferably maintains a desired atmosphere. For example, the atmosphere may include a gas under a desired pressure. Further, to increase cooling of elements contained within the cavity 622, the cavity may include a gas such as, for example, $N_2$ under a desired pressure. Further, starting voltages of the discharge lamp 642 may be lowered by filling the cavity 622 with a gas filling, such as nitrogen or nitrogen-neon, for example. However, it is also envisioned that the cavity 622 may maintain an atmosphere under vacuum conditions. A vacuum may increase operating temperatures of the discharge lamp 642. Accordingly, the atmosphere contained within the cavity 622 may be used to control cold/hot spot temperatures of the discharge lamp 642.

An optional shroud (or sleeve) such as, for example, a quartz shroud 646 may be located around at least part of the discharge lamp 642 so as to control cold/hot spot temperatures and/or provide protection in case of the discharge lamp 642 ruptures. The quartz shroud 646 may be held in place using any suitable mechanism. For example, holding devices 648 may be attached to parts of the wire frame 608 and used to hold the quartz shroud 646 in a desired position. The quartz shroud 646 may have an inside diameter of, for example, 22-28 mm when using a 330 W lamp according to the present system. However, other diameters are also envisioned. Optional oxygen and contamination (e.g., water, hydrogen, methane, and other hydrocarbon contaminations) removal devices, such as one or more getters 644, may be attached to one or more of the stem leads 606, 640 and function to remove oxygen from within the cavity 622 of the lamp 600.

Thus, according to the present systems and devices, a high-pressure, low-cost, reliable, and easily-ignited high-efficiency CDM-type lamps that may be used with probe and/or pulse ballasts are provided.

A graph illustrating experimental results for an MH lamp in accordance with an embodiment of the present system is shown in Table 4 below. In table 4, the sixth column is the luminous efficacy in lumens per watt, CCT is the correlated color temperature, CRI is the color rendering index, x and y are the color coordinates in the CIE (International Commission on Illumination) 1931 color space chromaticity diagram, and MPCD is the mean perceptible color difference. The bottom row in Table 4 illustrates results obtained using a conventional 400 W MH lamp.

TABLE 4

| Lamp | V | Current | Power | Lumens | Lm/W | CCT | CRI | x | y | MPCD |
|---|---|---|---|---|---|---|---|---|---|---|
| 1 | 138.4 | 3.05 | 354 | 40070 | 113.0 | 3929 | 90.1 | .382 | .372 | −6.7 |
| 2 | 138.0 | 3.06 | 358 | 38335 | 107.0 | 3719 | 93.2 | .388 | .368 | −17.6 |
| 3 | 138.2 | 3.06 | 360.0 | 37597 | 104.4 | 3877 | 91.0 | .384 | .374 | −5.9 |
| 4 | 136.4 | 2.92 | 340.2 | 35599 | 104.6 | 3819 | 91.0 | .385 | .369 | −13.2 |
| 5 | 138.5 | 3.00 | 344.2 | 36197 | 105.2 | 3859 | 92.0 | .385 | .374 | −6.5 |
| 6 | 138.5 | 3.05 | 352.8 | 39752 | 112.7 | 3883 | 90.8 | .384 | .375 | −5.2 |
| AVG | 138.0 | 3.02 | 351.7 | 37929 | 107.8 | 3848 | 91.3 | .385 | .372 | −9.2 |
| Quartz MH400 | 135 | 3.25 | 400 | 36000 | 90 | 4000 | 65 | | | +25 (typical) |

With reference to Table 4, the $100^{th}$ hour photometry data for an experimental lamp according to the present system using a 340 W lamp at nominal line voltage and reactor ballast is shown. The light technical properties (LTP) are read at nominal line voltage (e.g., 220V) on reactor ballast at 100 hours. The average efficacy is 107.8 lm/W compared to 90 lm/W for a conventional switch/probe start 400 W QMH lamp as seen from the column labeled Lm/W and rows labeled AVG (or average) and Quartz in Table 4. The calculated lumen maintenance may be better than that of conventional 400 W QMH lamps (e.g., 65% at 8000 hrs). Further, the color points of the lamp according to the present system are close to the Black Body Line (BBL).

A side view of an MH lamp 700 with an outer envelope in accordance with an embodiment of the present system is shown in FIG. 7. The lamp 700 includes a double bayonet mount 790. Further, an outward extending dimple 716 locates at least part of a wire frame 708 for supporting arc tube 730.

Figure 8:
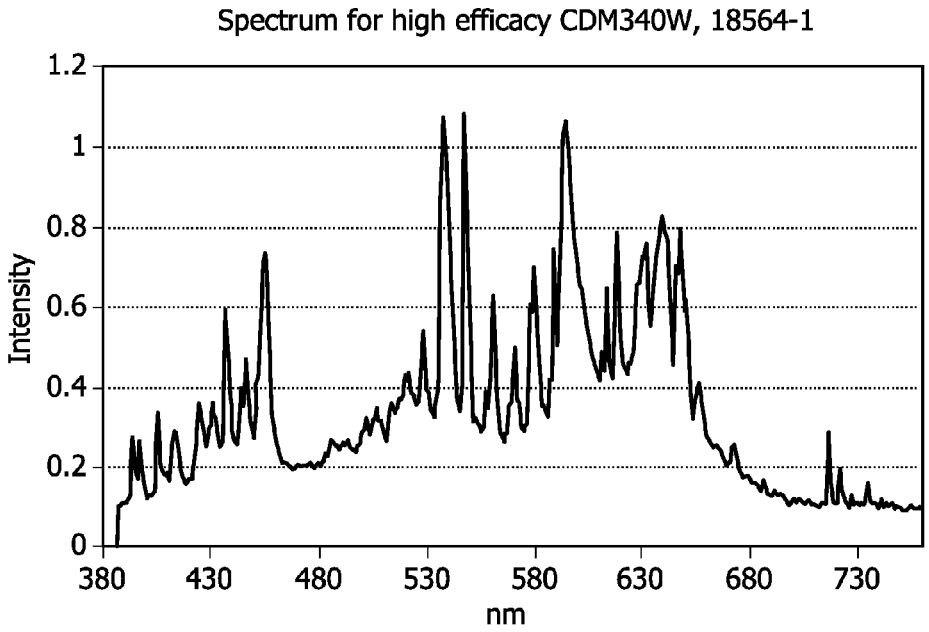
FIG. 8 is a graph illustrating an output spectrum for a 340 W lamp according to an embodiment of the present system.

A graph illustrating an output spectrum for a 340 W lamp according to an embodiment of the present system is shown in FIG. 8. An indium emission at 451 nm is pronounced. Because of a high lamp voltage ($L_V$) of about 136V as opposed to that of a conventional energy savings lamp of 100V, and high Hg pressure, the Ca molecular radiations in the range of 610 nm to 640 nm are enhanced. High radiation in a red region of the spectrum due to an N-T-C—C—In iodide chemical filling of a lamp according to the present system, reduces the color temperature to 3929K as opposed to a color temperature of 4000K-4300K for a conventional lamp with an Na—Sc filling.

Starting test results for a lamp according to an embodiment of the present system, will now be described in more detail. First, the lamps according to the present system started using a probe or switch start ballast without any igniter, such as a conventional M59 ballast. That is, the ceramic lamps according to the present invention operate using a probe start ballast without any internal/external igniter circuits or without any starting electrodes, probes or internal igniters. After 100 hrs operation, test lamps started at 170V line voltage (as opposed to nominal line voltage of 240V).

The present system is compatible with CWA-type ballasts and other magnetic ballasts, and operates with both probe start and pulse start ballasts. The lamp may be operated with a probe start ballast without an internal igniter circuit or without a starting electrode (or internal igniter). However, lumen maintenance on an electric ballast may be better than lumen maintenance on a CWA ballast. Further, the present system is compatible with M59 and M135 type ballasts. An LTP (Light Technical Properties) comparison of a 340 W ceramic lamp (e.g., referred to as a CDM340 W) according to the present ceramic lamps and conventional quartz lamps (e.g., a QMH switch/probe start 400 W, and a QMS pulse start 400 W) is shown in Table 5 below. It should be noted that the ceramic lamp according to the present device has superior qualities as compared with conventional quartz lamps, such as better color rendering and color temperature control, as well as superior lumen maintenance.

TABLE 5

| | Present System | Conventional 400 W lamps | |
|---|---|---|---|
| Properties | Energy-saving CDM340W | QMH400/ Probe start | QMS400/ Pulse start |
| Efficacy | 110 lm/W | 90 lm/W | 106.5 lm/W |
| Lumens | 36200 | 36000 | 42600 |
| Mean lumens | 28960 | 24000 | 29820 |
| CCT | 4000K | 4000K | 4000K |
| CRI | 90 | 65 | 65 |
| Lumen Maintenance % @ 8,000 hours | 80% | 65% | 70% |
| Life time | 20k hrs | 20k hrs | 20k hrs |
| Color shift | 200K | 600K | 600K |
| R9 | 55 | Negative | negative |
| Ballast (ANSI) | M59 or M135 | M59 | M135 |
| Operating watts | 340 W | 400 W | 400 W |
| Energy saving | 60 W (15%) | 0 | 0 |
| Energy saving $$ | $100 per lamp | 0 | 0 |

The second column in Table 5 refers to a 340 watt energy-saving CDM lamp that may be operated with either probe start or pulse start ballasts, such at M59 and/or M135 ANSI ballasts.

Although specifications for an exemplary 340 W lamp is described above, the energy savings lamp according to the present system may be readily expanded to medium wattage and high wattage applications. A table indicating possible energy savings for various lamps according to the present system over conventional lamps is shown in Table 3.

As described, the lamp system according to the present system may use a power factor chemistry (e.g., approx 0.82) which is lower than that of an Na—Sc system (e.g., 0.92) and therefore may not have an adverse effect on the efficiency or lifetime of a ballast. However, other power factors are also envisioned for example, a power factor of 0.75-0.85 may be used, as desired. Further, the power factor may be selected so that the nominal voltage is in accordance with requirements of a corresponding ballast.

Accordingly, there is provided a lamp system which has enhanced lamp performance characteristics such as high lumen output and excellent color properties. Further, the lamp system, depending upon wattage may be compatible with, for example, ANSI values for corresponding ballasts. For example, a 250 W replacement lamp (i.e., the 205 W lamp shown in Table 3) may be compatible with ANSI values for a M58 ballast.

Figure 9:
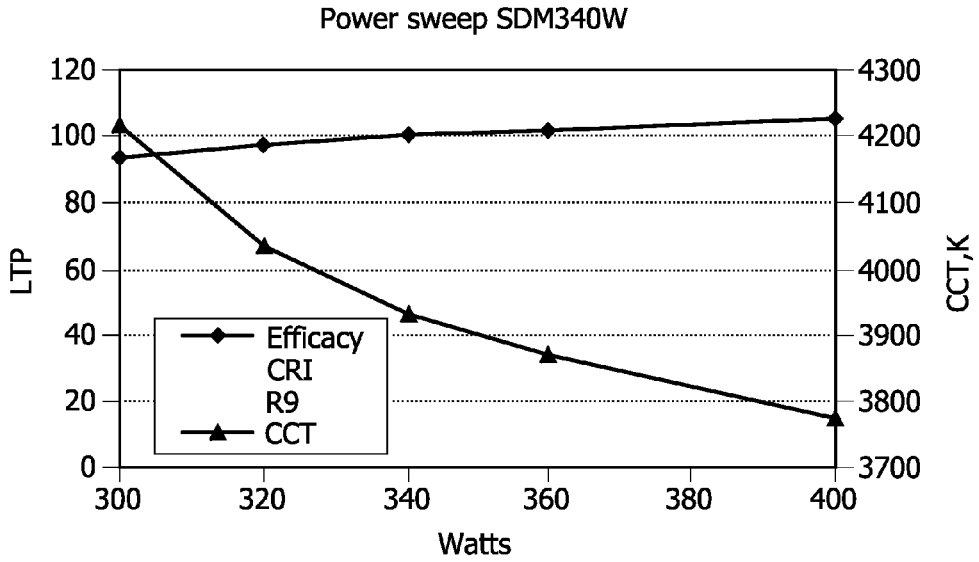
FIG. 9 is a graph illustrating power sweep of a 340 W lamp according to an embodiment of the present system.

A graph illustrating power sweep of a 340 W lamp according to an embodiment of the present system is shown in FIG. 9. A 1000 h test lamp was photometered at various power levels. When the power is reduced from 400 W to 300 W, the efficacy and CRI decreases but at a slow rate. CCT increases from 3800K at 400 W to 4200K at 300 W. R9 decreases from 85 @400 W to 44 @300 W. As this test was performed on a lamp which was aged for 1000 hrs, the efficacy and other light technical properties (LTP's) might be slightly different than 100 h readings.

Figure 10:
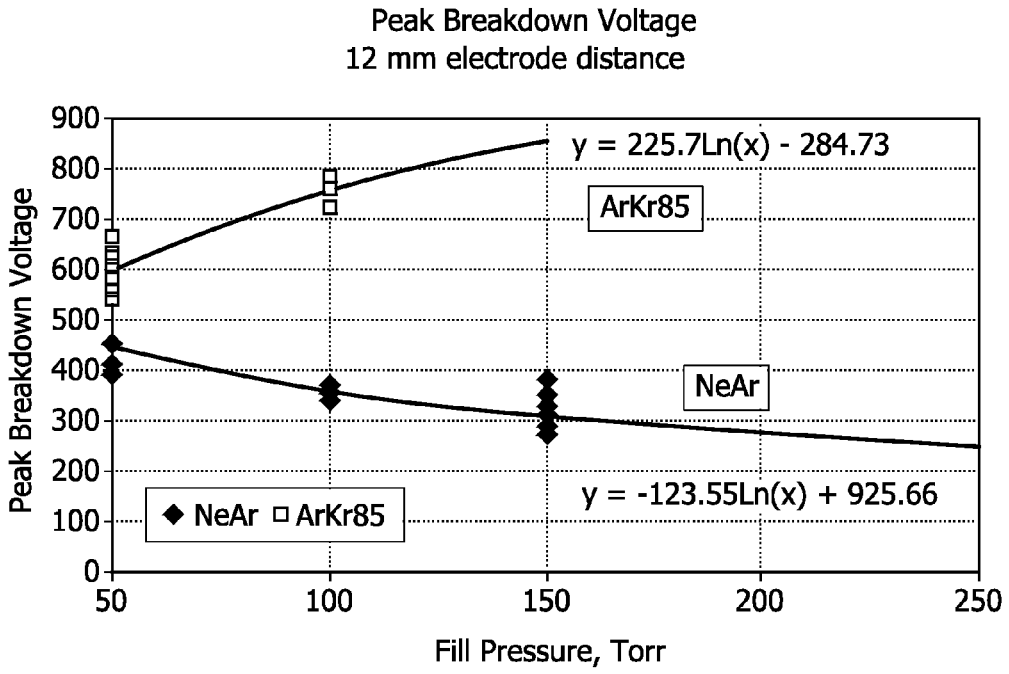
FIG. 10 is a graph illustrating breakdown vs. chemical filling pressure for lamps according to an embodiment of the present system.

A graph illustrating breakdown vs. chemical filling pressure for lamps according to an embodiment of the present system is shown in FIG. 10. A gas filled outer envelope (e.g., in the outer envelope 602) may compensate for the higher thermal conductivity of an Ne—Ar mixture which may be included within the discharge cavity of the lamp. This may be seen when comparing the maximum arc tube wall temperature measured in the horizontal orientation. When the outer envelop is kept in a vacuum, the maximum arc tube temperature may be approximately 60K higher for the Ne—Ar lamp than for a lamp with substantially argon at the same power. However, when the outer envelope is filled with a gas under pressure (e.g., $N_2$, at 300 torr nitrogen in the present example), the maximum arc tube temperature for Ne—Ar arc tube is the same as that of an arc tube which includes Ar and which is operated in an outer envelope which includes a vacuum (e.g., see, FIG. 13). Further, the breakdown voltage may be lower when using a gas filled outer envelope. This was measured on 205 W lamps and shown in FIG. 14 where these lamps are ED28 and have 175 torr of $N_2$ filling in the lamp.

Figure 11:
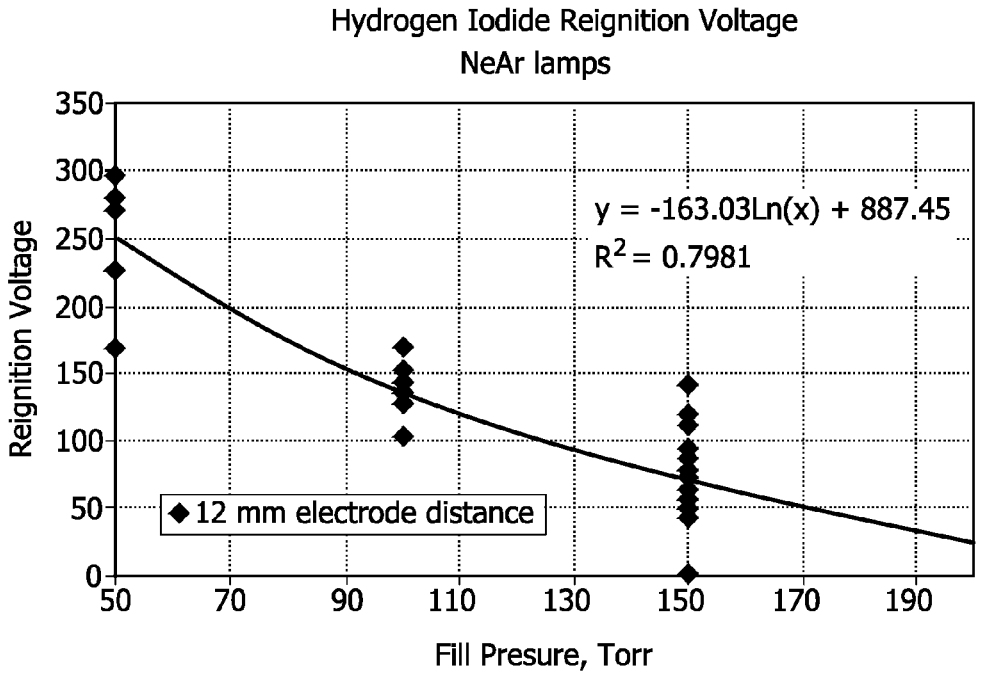
FIG. 11 is a graph illustrating re-ignition voltage vs. pressure for new Ne—Ar filled lamps according to an embodiment of the present system.

A graph illustrating re-ignition voltage vs. pressure for new Ne—Ar filled lamps according to an embodiment of the present system is shown in FIG. 11.

Figure 12:
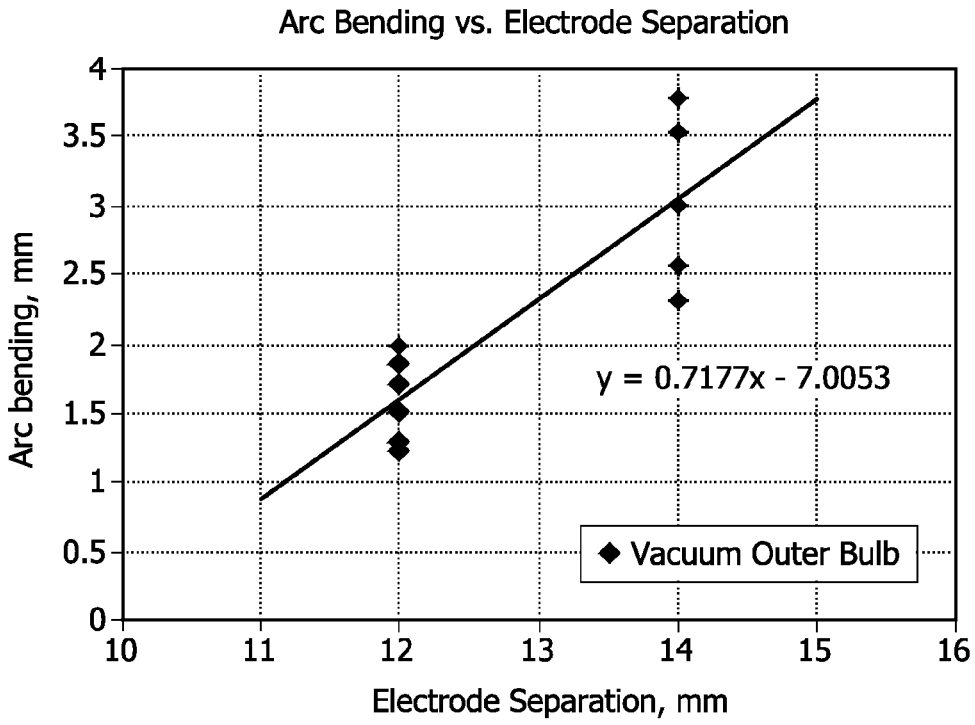
FIG. 12 is a graph illustrating arc bending vs. electrode separation for Ne—Ar lamps with a frame wire situated below the lamps according to an embodiment of the present system.

A graph illustrating arc bending vs. electrode separation for Ne—Ar lamps with a frame wire situated below the lamps according to an embodiment of the present system is shown in FIG. 12. As mentioned above, arc bending due to using a lighter gas can be offset by placing the electrodes closer together. A further benefit of placing electrodes closer together is that luminous efficiency may increase.

Figure 13:
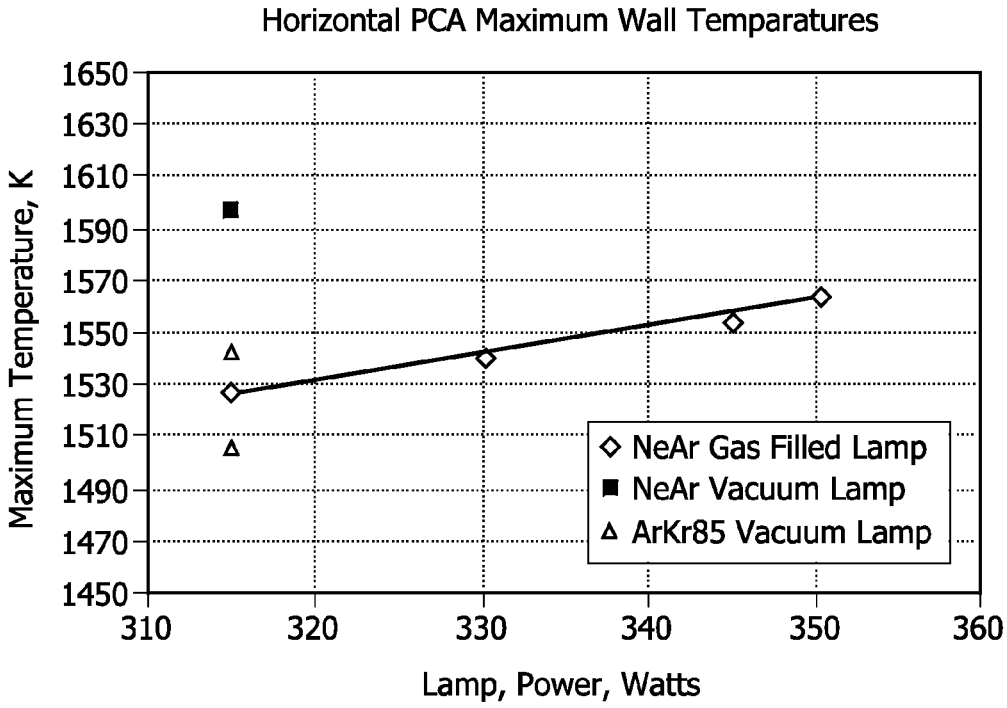
FIG. 13 is a graph illustrating maximum arc tube wall temperature vs. power for gas filled and vacuum outer envelopes according to an embodiment of the present system.

A graph illustrating maximum arc tube wall temperature vs. power for gas filled and vacuum outer envelopes according to an embodiment of the present system is shown in FIG. 13. With reference to FIG. 13, arc tubes with $ArKr^{85}$ are shown for comparison.

Figure 14:
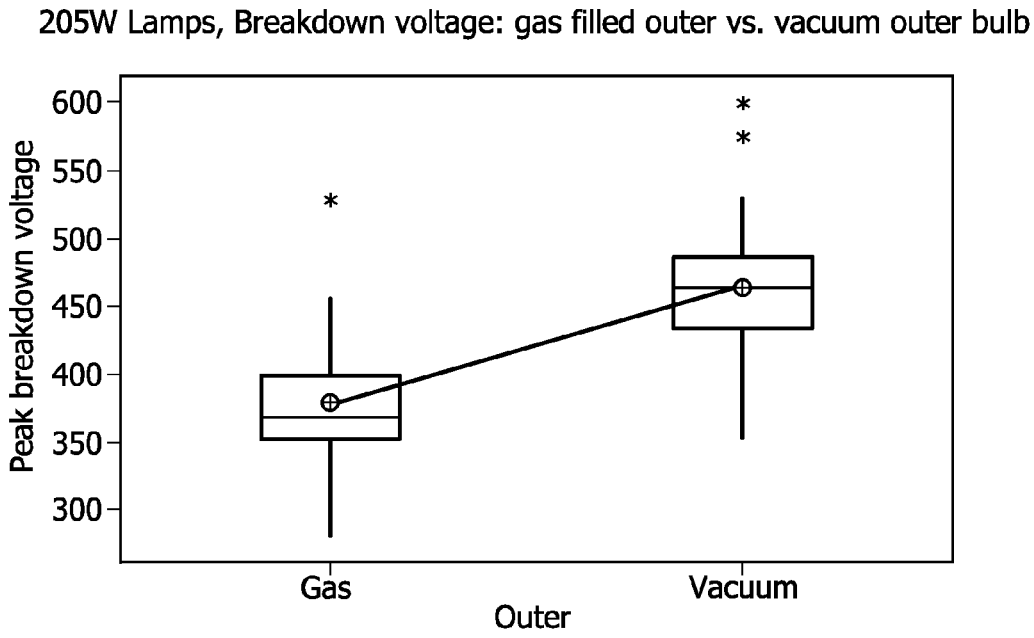
FIG. 14 is a graph illustrating breakdown voltage for gas filled and vacuum outer envelopes according to an embodiment of the present system.

A graph illustrating breakdown voltage for gas filled and vacuum outer envelopes according to an embodiment of the present system is shown in FIG. 14.

Figure 15:
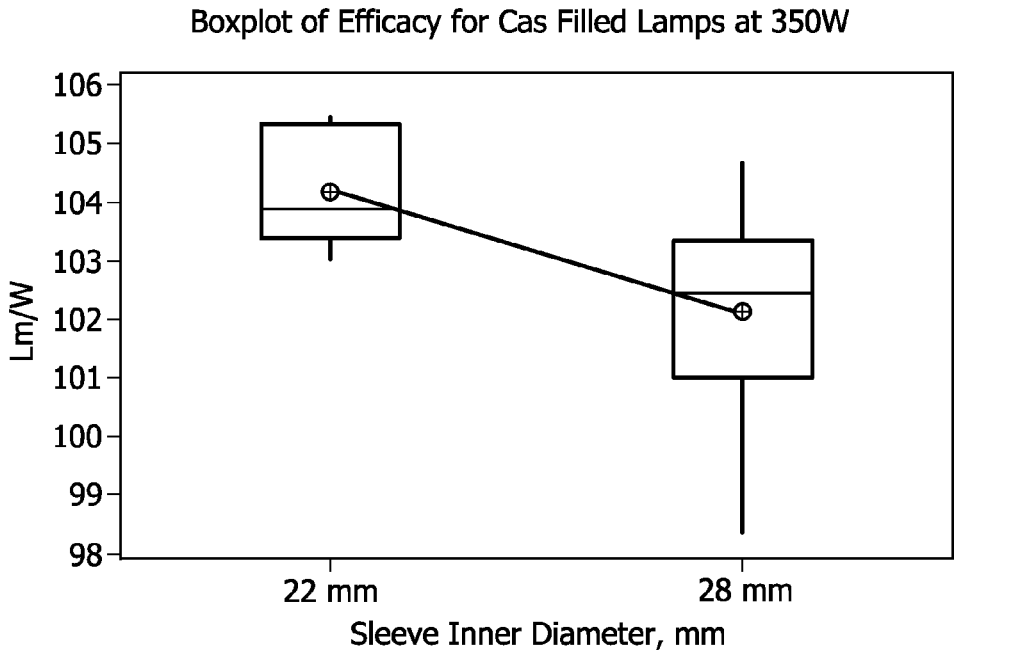
FIG. 15 is a graph illustrating efficacy vs. inner sleeve diameter for lamps operated at 350 watts in a gas filled outer envelope according to an embodiment of the present system.

A graph illustrating efficacy vs. inner sleeve diameter for lamps operated at 350 watts in a gas filled outer envelope according to an embodiment of the present system is shown in FIG. 15. When operating in a gas filled environment the salt temperature may become too cold to achieve the required lamp efficacy. Accordingly, a quartz glass shroud (e.g., a sleeve) may placed around the arc tube to act as an insulating shield and also as part of the containment protection so that the lamp can pass the ANSI containment test and allow the lamp to be rated for use in open fixtures. The size of the shroud may be important, if the shroud is too large, it may not provide sufficient insulation for the arc tube, and if the shroud is too small, it may contribute to additional cooling of the arc tube. Accordingly, the shape and size of the shroud should be adjusted to yield a desired amount of insulation. One method to achieve this is to adjust the inside diameter (ID) of the shroud such that the shroud provides a desired thermal insulation.

Figure 16:
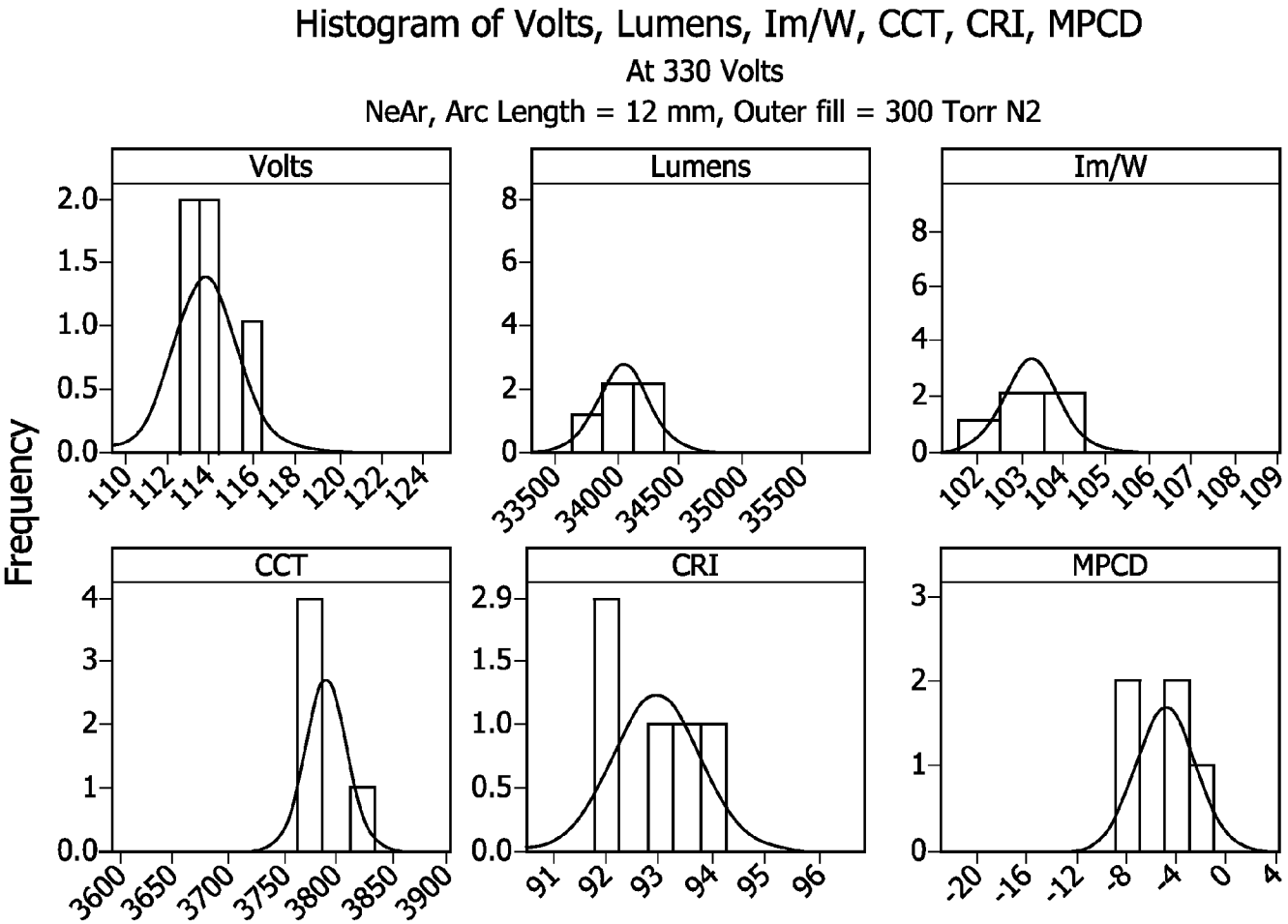
FIG. 16 is a graph illustrating photometric results at 100 hours for 330 W lamps according to an embodiment of the present system.

A graph illustrating photometric results at 100 hours for 330 W lamps according to an embodiment of the present system is shown in FIG. 16. Graph 1600 illustrates photometric results at 100 hours for 330 W lamps in a base up operating mode.

Figure 17:
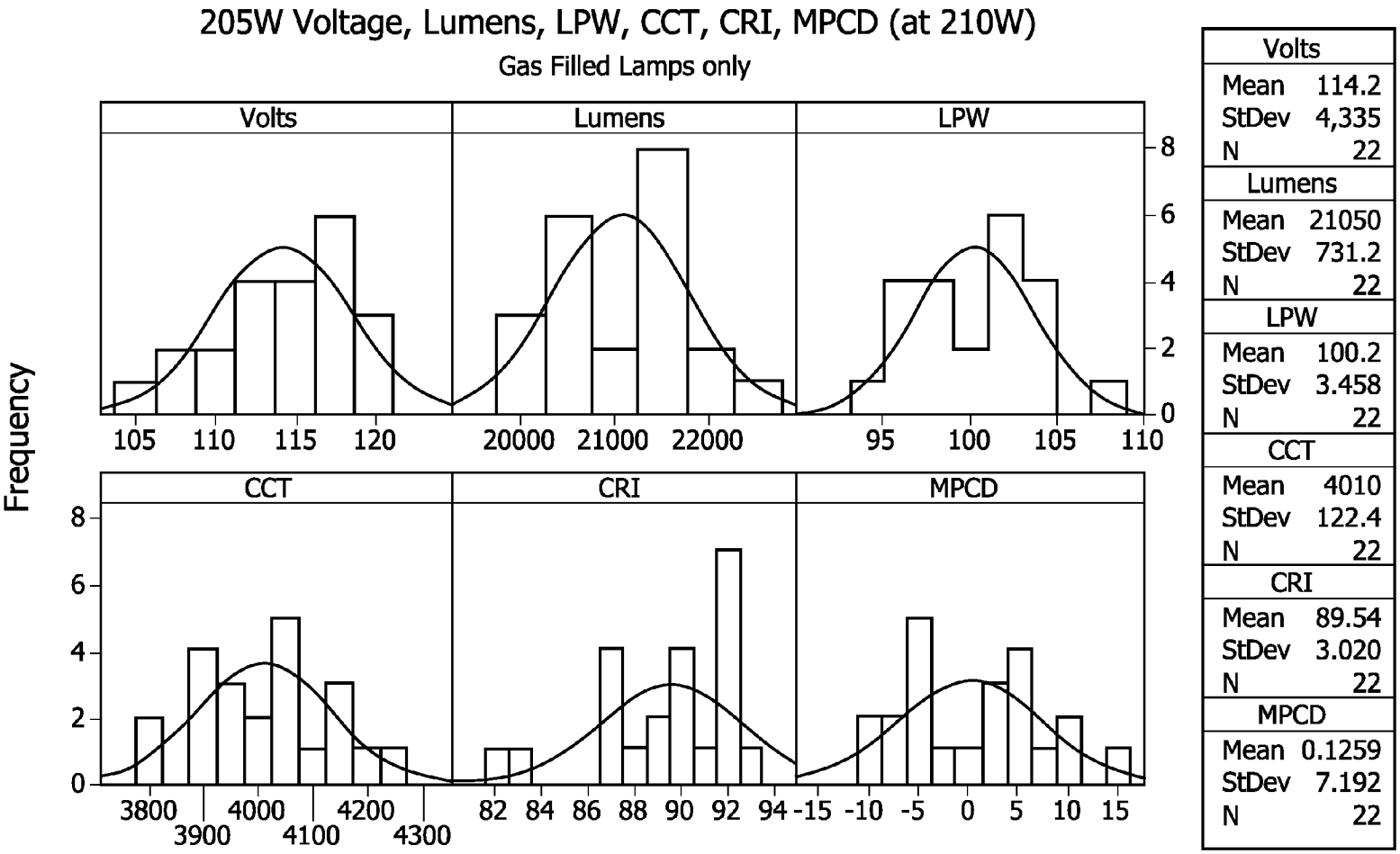
FIG. 17 is a graph illustrating photometric results at 100 hours for 205 W lamps according to an embodiment of the present system.

A graph illustrating photometric results at 100 hours for 205 W lamps according to an embodiment of the present system is shown in FIG. 17. Graph 1700 illustrates photometric results at 100 hours for 205 W lamps in a base up operating mode.

Certain additional advantages and features of this system may be apparent to those skilled in the art upon studying the disclosure, or may be experienced by persons employing the novel system and method of the present system, chief of which is that a more reliable and easily started HPS lamp which may be operated using conventional fixture components is provided. Another advantage of the present systems and devices is that conventional lamps can be easily upgraded to incorporate the features and advantages of the present systems and devices.

Of course, it is to be appreciated that any one of the above embodiments or processes may be combined with one or more other embodiments and/or processes or be separated and/or performed amongst separate devices or device portions in accordance with the present systems, devices and methods.

Finally, the above-discussion is intended to be merely illustrative of the present system and should not be construed as limiting the appended claims to any particular embodiment or group of embodiments. Thus, while the present system has been described in particular detail with reference to exemplary embodiments, it should also be appreciated that numerous modifications and alternative embodiments may be devised by those having ordinary skill in the art without departing from the broader and intended spirit and scope of the present system as set forth in the claims that follow. Accordingly, the specification and drawings are to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof;

f) hardware portions may be comprised of one or both of analog and digital portions;

g) any of the disclosed devices or portions thereof may be combined together or separated into further portions unless specifically stated otherwise;

h) no specific sequence of acts or steps is intended to be required unless specifically indicated; and i) the term "plurality of" an element includes two or more of the claimed element, and does not imply any particular range of number of elements; that is, a plurality of elements may be as few as two elements, and may include an immeasurable number of elements.

What is claimed is:

1. A discharge lamp, comprising:

a ceramic discharge vessel defining at least part of a cavity contains a metal halide filling; and one or more feedthroughs having first and second ends, the first end located in the cavity;

wherein the discharge lamp is configured to start and operate with a probe start ballast not having a high-voltage igniter or a high-voltage ignition circuit; and, wherein the lamp operates without starting electrodes and said metal halide filling includes a combination of predetermined elements to produce a desired power factor of between 0.75 and 0.85, wherein the filling comprises a mixture selected from one of an Na—Tl—Ca—Ce—In iodide, Na—Tl—Ca—Ce—Mn iodide, Na—Tl—Ca—Ce—Mg iodide, Na—Tl—Ca—Ce—In—Cs iodide, and Na—Tl—Ca—Ce—Mn—Cs iodide fillings.

2. The discharge lamp of claim 1, wherein the metal halide filling produces a power factor of between 0.75 and 0.8.

3. The discharge lamp of claim 1, wherein the cavity has an internal length LINT and an internal diameter $D_{INT}$ that are proportional to each other, such that an aspect ratio defined as $L_{INT}/D_{INT}$ is less than or equal to two.

4. The discharge lamp of claim 3, wherein the filling has a pressure that is in a range of about 150 to about 200 Torr.

5. The discharge lamp of claim 1, wherein the filling further comprises a Neon—Argon (Ne—Ar) Penning mixture which comprises between about 98.0-99.5% Ne and of the Ne—Ar Penning mixture being Ar.

6. The discharge lamp of claim 1, wherein the filling further comprises a trace amount of $Kr^{85}$.

7. The discharge lamp of claim 1, wherein the one or more feedthroughs are separated from each other so as to define an arc length that is between about 12 mm and 14 mm.

8. The discharge lamp of claim 1, further comprising an antenna coupled to one of the one or more feedthroughs, wherein the antenna is formed integrally with the discharge vessel.

9. The discharge lamp of claim 1, further comprising a quartz sleeve situated around at least a part of the ceramic discharge vessel, the quartz sleeve having an inner diameter between 20 mm and 28 mm and a length between 50 mm to 70 mm.

10. The discharge lamp of claim 9, further comprising a gas located between the ceramic discharge vessel and the quartz sleeve, the gas having a pressure that is between 100 and 400 Torr.

11. A method of forming a discharge lamp, the method comprising the acts of:

forming a ceramic discharge vessel defining a cavity;

filling the cavity with a metal halide filling located within the cavity, said metal halide filling having a power factor of between 0.75 and 0.85, wherein the filling comprises a mixture selected from one of an Na—Tl—Ca—Ce—In iodide, Na—Tl—Ca—Ce—Mn iodide, Na—Tl—Ca—Ce—Mg iodide, Na—Tl—Ca—Ce—In—Cs iodide, and Na—Tl—Ca—Ce—Mn—Cs iodide fillings; and positioning one or more feedthroughs partially within the cavity so as to seal the cavity so that the discharge lamp starts and operates without a starting electrode and with a probe start ballast not having high-voltage igniters or high-voltage ignition circuits.

12. The method of claim 11, wherein the metal halide filling produces a power factor of between 0.75 and 0.8.

13. The method of claim 11, wherein the act of filling further comprises the act of inserting a Neon-Argon Penning mixture within the cavity, the Neon—Argon (Ne—Ar) Penning mixture having a range that is between about 98.0 to about 99.5% Ne and a remainder of the Ne—Ar Penning mixture comprising Ar.

14. The method of claim 11, wherein the act of filling further comprises the act of adjusting a pressure of the chemical filling such that the pressure is in a range of substantially 150 to substantially 200 Torr.

15. The method of claim 11, wherein the act of positioning comprises the act of positioning each of the one or more feedthroughs separate from each other so as to define an arc length that is substantially between 12 mm and 14 mm.

* * * * *